US006022632A

United States Patent [19]

Olson et al.

[11] Patent Number: 6,022,632

[45] Date of Patent: Feb. 8, 2000

[54] LOW ACTIVITY LOCALIZED ALUMINIDE COATING

[75] Inventors: Walter E. Olson, Vernon; Norman Pietruska, Durham; Peter Jon Draghi, Simsbury, all of Conn.

[73] Assignee: United Technologies, Hartford, Conn.

[21] Appl. No.: 08/733,590

[22] Filed: Oct. 18, 1996

[51] Int. Cl.[7] ..... B32B 15/10

[52] U.S. Cl. ..... 428/650; 428/652; 428/653

[58] Field of Search ..... 428/650, 652, 428/601, 653

[56] References Cited

U.S. PATENT DOCUMENTS

| | | | |
|---|---|---|---|
| 3,102,044 | 8/1963 | Joseph | 117/22 |
| 3,257,230 | 6/1966 | Wachtell et al. | 117/107.2 |
| 4,004,047 | 1/1977 | Grisik | 427/142 |
| 4,142,023 | 2/1979 | Bornstein et al. | 428/680 |
| 4,944,858 | 7/1990 | Murphy et al. | 204/192.15 |
| 5,217,757 | 6/1993 | Milaniak et al. | 427/253 |
| 5,334,417 | 8/1994 | Rafferty et al. | 427/253 |
| 5,366,765 | 11/1994 | Milaniak et al. | 427/229 |
| 5,523,169 | 6/1996 | Rafferty et al. | 428/551 |
| 5,658,614 | 8/1997 | Basta et al. | 427/253 |

*Primary Examiner*—D. S. Nakarani
*Assistant Examiner*—Holly C Rickman
*Attorney, Agent, or Firm*—John E. Boyd, Esq.; Whitman Breed Abbott & Morgan LLP

[57] ABSTRACT

The invention includes a low activity localized aluminide coating for a metallic article made by positioning a coating material, preferably in the form of a tape, on a portion of the article. The coating material comprises a binder, a halide activator, an aluminum source, and an inert ceramic material. The coating material and the article are heated in an inert atmosphere between about 1800° F. (982° C.) and about 2050° F. (1121° C.) for between about four and about seven hours thereby producing a low activity localized aluminide coating having an outward diffusion aluminide coating microstructure characterized by two distinct zones, an inner diffusion zone and an outer zone including between about 20–28 percent, by weight, aluminum.

17 Claims, 1 Drawing Sheet

LOW ACTIVITY LOCALIZED ALUMINIDE COATING

BACKGROUND OF THE INVENTION

1. Technical Field

This invention relates generally to aluminide coatings and particularly to aluminide coatings which are resistant to oxidation degradation and thermal fatigue cracking.

2. Background Information

Aluminide coatings are known to provide oxidation and corrosion protection for superalloy articles, such as blades and vanes, used in gas turbine engines. Such coatings are favored in the gas turbine engine industry because they are economical and add little weight to the engine.

Aluminide coatings may be formed by a pack process wherein a powder mixture, including an inert material, a source of aluminum, and a halide activator is employed. The superalloy to be coated is inserted into a coating box and covered with the powder mixture or pack. The coating box is then placed in a retort. A reducing or inert gas is then flowed through the retort. During the coating process, the halide activator reacts with the source of aluminum and produces an aluminum-halide vapor which circulates over the surface of the superalloy article. Upon contact with the surface of the superalloy article, the vapor decomposes and deposits aluminum on the superalloy surface whereby the halide is released and contacts the aluminum source to continue the chemical reaction. The deposited aluminum then combines with nickel from the superalloy surface thereby forming an aluminum-rich surface layer or coating on the superalloy article. Use of this pack process is advantageous when it is desired to coat the entire surface of a superalloy article. However, it is difficult to coat select portions of the article without the employment of detailed masking techniques.

Another known technique for forming an aluminum-rich surface layer on a superalloy article is a vapor phase aluminiding process. Generally, in this process the superalloy article is suspended in an out-of-contact relationship with the above described powder mixture as opposed to being embedded within the powder mixture. However, problems are associated with some vapor phase aluminiding processes. For example, formation of undesirable oxides within the coating itself and on the original substrate surface may be encountered. These oxides are undesirable because they may degrade the coating properties.

U.S. Pat. No. 3,102,044 to Joseph describes another method of forming an aluminum-rich surface layer on a superalloy article. In this method an aluminum-rich slurry is applied to the superalloy surface and heat treated to form a protective aluminide coating thereon. Although such aluminum-rich slurry techniques can be successful in producing a protective aluminide coating on the surface of the superalloy article, it is very labor intensive and time consuming to coat an entire superalloy article in this fashion. Achieving coating uniformity from one location on the article surface to another can be difficult. Furthermore, even if it is desired to coat only a portion of the article, such as a small area damaged during engine operation or damaged during handling in the manufacturing process, care must be taken in applying the slurry only to those areas in need of coating. Thus, detailed masking techniques may be necessary.

U.S. Pat. No. 5,334,417 to Rafferty et al. describes yet another method of producing an aluminide coating.

Specifically, Rafferty et al. disclose a method for forming a pack cementation coating on a metal surface by a coating tape. The tape includes elemental metal, a filler, a halogen carrier composition and a binder material, specifically fibrillated polytetrafluoroethylene. According to Rafferty et al., the components are formed into a malleable tape and cut to the desired size. To form the pack cementation coating, the tape is placed on the surface of the part which is put in an oven and heated to a temperature of about 1250° F. (677° C.) to 1350° F. (732° C.) for 0.5 to about 3 hours with the typical time being about 1.5 hours. The process causes a chemical reaction to occur in which fluoride or chloride compound breaks down to form halide ions which react with the metal (or metal alloy) atoms forming the metal halide compound. When the metal halide contacts the base metal surface, the metal in the metal halide compound is reduced to elemental metal which can alloy with the base metal. More specifically, metal ions, such as aluminum, vanadium or chromium react with the nickel, iron or cobalt of the base metal to form the aluminide or nickel vanadium or nickel chromium composition.

Although Rafferty et al. seem to address the need for an efficient way to coat select portions of gas turbine engine components, the above described resultant coating does not appear to be a fully diffused coating. Thus, it is brittle and may be dislodged from the component, for example, during handling or during engine operation.

Notwithstanding the advances made in the aluminiding field, scientists and engineers under the direction of Applicant's Assignee continue in their attempts to develop aluminide coatings. Such coatings must have excellent resistance to oxidation and corrosion attack and must be particularly resistant to thermal fatigue cracking, as well as economical and easy to apply, particularly to select portions of gas turbine engine components. The invention results from such effort.

DISCLOSURE OF THE INVENTION

According to the invention, a low activity localized aluminide coating and methods of producing such coating are disclosed. A key feature of the invention is that the resultant coating has an outward type diffusion aluminide coating microstructure resulting in the desirable properties of resistance to oxidation degradation as well as resistance to thermal fatigue cracking.

An aspect of the invention includes a low activity localized aluminide coating for a metallic article made by positioning a coating material, preferably in the form of a tape, on a portion of the article. The coating material comprises a binder, a halide activator, an aluminum source, and an inert ceramic material. The coating material and the article are heated in an inert atmosphere between about 1800° F. (982° C.) and about 2050° F. (1121° C.) for between about four and about seven hours thereby producing a low activity localized aluminide coating having an outward diffusion aluminide coating microstructure characterized by two distinct zones, an inner diffusion zone and an outer zone including between about 20–28 percent, by weight, aluminum.

Another aspect of the invention includes a method of producing a low activity localized aluminide coating on a metallic article. The method comprises the steps of: positioning the above described coating material on a portion of the article and heating the coating material and the article in an inert atmosphere between about 1800° F. (982° C.) and about 2050° F. (1121° C.) for between about four and about seven hours thereby producing a low activity localized aluminide coating having an outward diffusion aluminide coating microstructure characterized by two distinct zones, an inner diffusion zone and an outer zone including between about 20–28 percent, by weight, aluminum.

Coatings made according to this invention have excellent resistance to thermal fatigue cracking as well as excellent resistance to oxidation degradation. Thus, the invention has great utility in the gas turbine engine industry. Other features and advantages of the invention will become apparent to those skilled in the art from the following.

BEST MODE FOR CARRYING OUT THE INVENTION

Figure 1:
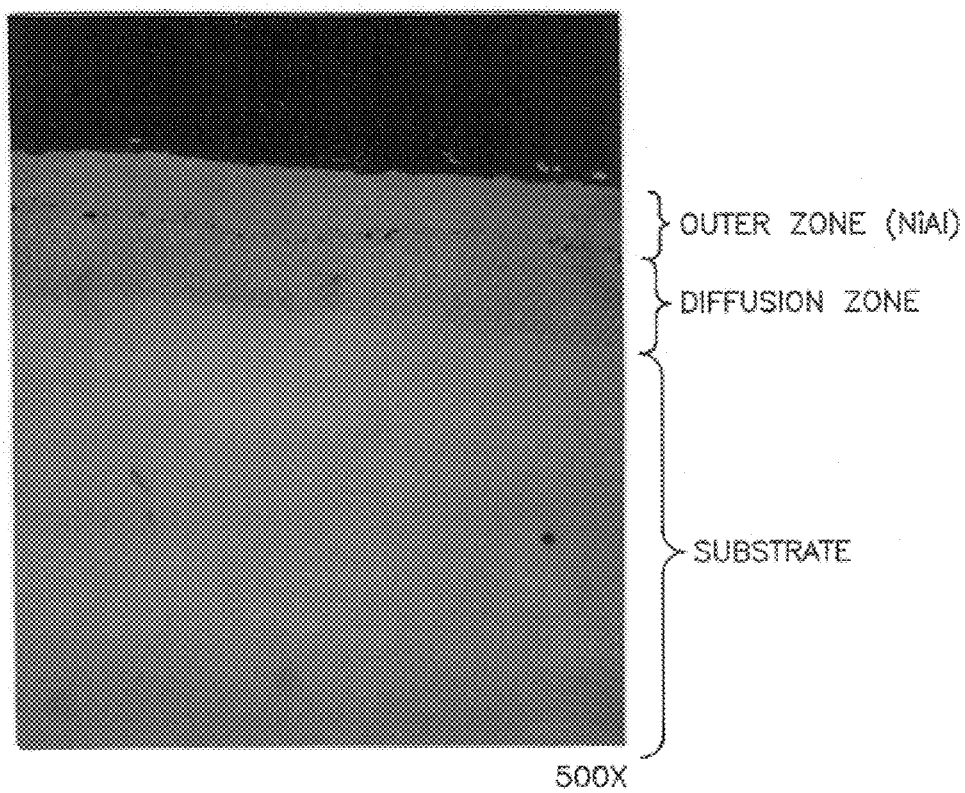
FIG. 1 is a photomicrograph of the low activity, outwardly diffusing, aluminide coating of the invention.

Applicants have discovered a low activity, outwardly diffusing localized aluminide coating particularly suited for the aggressive gas turbine engine environment. Outwardly diffusing aluminide coatings may be formed when the coating application parameters (primarily temperature and aluminum activity) are such to promote diffusion of aluminum into the substrate and diffusion of the substrate elements outwardly towards the substrate surface. By localized we herein mean that the coating material is applied to select portions of a substrate, preferably in the form of a coating tape. However, one skilled in the art will appreciate that the coating material may be in other forms suitable for coating select portions of a substrate.

A key feature of the invention is that the resultant coating after heat treatment has an outward type diffusion aluminide coating microstructure characterized by two distinct zones resulting in the desirable properties of resistance to oxidation degradation as well as resistance to thermal fatigue cracking.

The low activity localized aluminide coating tape of the invention may be applied to various metallic substrates. However, it is particularly suited for nickel base superalloy articles such as gas turbine blades and vanes.

The surface of the article should preferably be cleaned prior to application of the coating tape. For example, conventional aluminum oxide grit blasting may be employed to clean the surface of the article.

The low activity localized aluminide coating tape of the invention includes a binder, a halide activator, an aluminum source, balance an inert ceramic filler material. Each constituent of the coating tape will now be described in detail.

The binder serves to strengthen the coating tape and may generally be any material capable of holding the coating constituents together without detrimentally interfering with the properties of the coating tape nor detrimentally interfering with the properties of the superalloy article. However, the binder must be capable of evaporating during heat treatment without leaving an undesirable residue. Suitable binders may include polytetrafluoroethylene, polyethylene, polypropylene, urethane, acrylics and mixtures thereof. Preferably, the binder is a high molecular weight polymer, polytetrafluoroethylene, sold by Du Pont, Wilmington, Del. as Teflon® 6C. The amount of binder employed may range between about 1 wt. % and about 15 wt. % and preferably between about 6 wt. % and about 9 wt. %.

In addition to the binder, a halide activator is employed. The halide activator serves as a transporter or carrier of aluminum to the surface of the article to be coated. The halide activator can be any one of a number of halide compounds, including, for example, aluminum tri-fluoride, sodium fluoride, lithium fluoride, ammonium fluoride, ammonium chloride, potassium fluoride, potassium bromide, and mixtures thereof. Preferably, the halide activator is between about 0.25 wt. % and about 5 wt. % aluminum tri-fluoride and most preferably about 1 wt. % powdered aluminum tri-fluoride.

In addition to the binder and the halide activator, an aluminum source is also included as a coating constituent. The aluminum source may be any number of suitable high melting point aluminum compounds which do not melt during the subsequent coating diffusion heat treatment. For example, cobalt aluminum, chromium aluminum, iron aluminum, and mixtures thereof may be employed. Preferably, an aluminum compound, between about 5 wt. % and about 50 wt. % is employed and most preferably, about 30 wt. % chromium aluminum (−48M./+325M.) is employed. However, elemental aluminum or aluminum silicon should not be used as the aluminum source because such aluminum sources will not result in the desired low activity, outwardly diffusing, two zone microstructure.

In addition to the binder, halide activator and aluminum source, the invention also includes an inert ceramic filler material. The inert ceramic filler material may be any such material capable of preventing the constituents from sintering together during the process. Calcined aluminum oxide (−120M./+325M.) is the preferred filler material. Generally, between about 30 wt. % and 90 wt. % aluminum oxide may be employed. Preferably, about 69 wt. % aluminum oxide is employed.

An inhibitor, such as chromium, cobalt, nickel, titanium, and mixtures thereof may also be employed as a constituent if necessary to lower the activity of the resultant coating. The inhibitor acts as a "getter of aluminum" or another location in which the aluminum may be deposited, thereby reducing and slowing down the amount of aluminum deposited on the superalloy substrate. Between about 5 wt. % and about 20 wt. % inhibitor may be employed. Preferably, between about 5 wt. % and about 10 wt. % chromium (−325M.) is employed as the inhibitor if it is necessary to lower the activity of the resultant coating and achieve the desired two zone microstructure. Conventional metallurgical analysis techniques may be employed to determine microstructure.

The above constituents are combined to preferably form a tape. Formation of the constituents into tape form is conventional and includes manufacturing techniques disclosed in U.S. Pat. No. 5,334,417, the contents of which are herein incorporated by reference. In general, the constituents are mixed together. The resultant mixture is then removed and rolled into the desired tape thickness. The thickness of the tape is preferably between about 0.015 inches (0.038 cm) and about 0.090 inches (0.229 cm) and most preferably between about 0.030 inches (0.076 cm) and about 0.060 inches (0.152 cm).

The tape is cut to the desired shape and size which is dependent upon the size of the area requiring coating. The tape is then applied to the article in at least one layer. However, multiple layers may be employed depending upon the desired thickness of the resulting coating.

Preferably, the tape is applied to the article with the use of a suitable adhesive. The adhesive is conventional and may be any adhesive capable of adhering the tape to the article, for example, we have used conventional Elmer's school glue. Other suitable adhesives may include Nicrobraz® products, such as Nicrobraz 300 and Nicrobraz Cement S, by Wall Colmonoy Corp., Madison Heights, Mich. However, the adhesive must not detrimentally interfere with the coating process and must be capable of evaporating during subsequent heat treatment without leaving any deleterious residue. Preferably, the tape is manufactured with the adhesive attached to the backing of the tape such that a peel off strip may be employed to expose the adhesive on the backing of the tape for attachment to the article.

As noted above, the adhesive used to secure the tape to the article will evaporate cleanly during the subsequent heat treatment process. As a result, if it desired to coat an area such as an underside, side or tip portion of an article, for example, additional steps should be employed to ensure that the coating tape is not dislodged prior to completion of the heat treatment process.

We have discovered a novel approach to secure the tape to the article even after the adhesive evaporates. The approach includes wrapping the tape (which is secured to the article with adhesive) and areas of the article immediately adjacent thereto with a nickel foil. Preferably nickel foil is employed, however, other suitable materials for the wrap may include stainless steel.

The nickel foil is conventional and is preferably between about 0.001 inches (0.025 mm) and 0.002 inches (0.051 mm) thick. The size of nickel foil employed is dependent upon the size of the area in need of coating. Preferably, the nickel foil also has an adhesive attached to its backside, as described above for the coating tape; this is preferred, but not necessary for effective use of the nickel foil. A suitable nickel foil includes that which is sold by Teledyne-Rodney Metals under the namne Adhesive-Backed Nickel 200 Foil.

As noted above, the foil is wrapped around the tape and the areas of the article immediately adjacent thereto. Such overlapping ensures that the foil will remain properly secured even at temperatures at which the adhesive evaporates.

An advantage of the use of the nickel foil includes the ability to effectively hold the tape in place during the heat treatment process. This embodiment is particularly advantageous for coating the underside of a turbine blade platform or both sides of a turbine airfoil concurrently. This approach is a novel, cost and time effective way to ensure that the coating tape remains secure during the subsequent heat treatment process. Additionally, coating vapors are produced during the subsequent heat treatment process. Use of this foil wrap will contain the coating vapors and thereby prevent possible air contamination as well as prevent coating in undesired locations.

After the coating tape is placed or secured on a portion of the superalloy article in need of coating, the article is then placed in a retort and processed in dry argon or hydrogen at approximately 1800° F. (982° C.) to about 2050° F. (1121° C.) for four to seven hours and preferably at approximately 1950° F. (1066° C.) to about 2000° F. (1093° C.) for four to seven hours.

During this process (in the case of application to a nickel base superalloy article), the nickel from the nickel base superalloy slowly diffuses outward from the superalloy to the surface of the article to combine with aluminum, thereby building up a layer of essentially pure NiAl. The resultant coating is a two zone, outwardly diffusing aluminide coating between about 0.001 inches (0.025 mm) and about 0.003 inches (0.076 mm) thick. The coating exhibits a diffusion zone having a thickness which is approximately half of the coating thickness.

Any present nickel foil is removed and a light cleaning operation with a stiff brush or a cosmetic abrasive grit blast may then be employed after the heat treatment process to remove any remaining residue around the coated area.

The resultant low activity, localized aluminide coating of the invention has greater thermal fatigue resistance than that of a high activity, inwardly diffusing localized aluminide coating. A high activity, inwardly diffusing aluminide coating is characterized by a three zone microstructure (precipitate zone, phase pure zone and diffusion zone) with considerable phase precipitation in the NiAl rich outer zone, in the case of a nickel base substrate. The high aluminum activity of this coating causes a rapid diffusion of aluminum into the substrate, resulting in a high aluminum content in the outer precipitate zone. The aluminum content is high enough in this outer zone such that those elements that were previously alloyed with the nickel base substrate are no longer able to stay in solution, thereby forming intermetallic particles. While these types of coatings have good resistance to oxidation, they are considerably thick and have lower ductility and thermal fatigue resistance in comparison to aluminide coatings of the outward type.

Accordingly, the invention is much more desirable than high activity, inwardly diffusing aluminide coatings for certain applications such as reducing the propensity for crack formation in superalloy articles of gas turbine engines.

The present invention may be further understood by way of example which is meant to be exemplary rather than limiting.

EXAMPLE

A low activity, outwardly diffusing localized aluminide coating was produced by the following: First, 65.1 wt. % aluminum oxide, 28.2 wt. % chromium aluminum, 0.9 wt. % aluminum tri-fluoride, and 5.7 wt. % polytetrafluoroethylene were mixed together and manufactured into tape form. The thickness of the tape was 0.030 inches (0.076 cm).

The tape was cut to the desired shape and size and applied under the platform of a high pressure turbine blade made of a single crystal nickel base superalloy material known as PWA 1484. Conventional Elmer's glue was used to secure the tape to the superalloy substrate. The blade was heat treated at 1975° F. (1079° C.) for 6.5 hours in an argon atmosphere.

FIG. 1 shows the microstructure of the resultant low activity, outwardly diffusing aluminide coating which is approximately 0.0015 inches (0.038 mm) thick and contains an inner diffusion zone that is approximately half the width of the coating. The outer zone of essentially pure NiAl includes between about 20–28 percent, by weight, aluminum.

Figure 2:
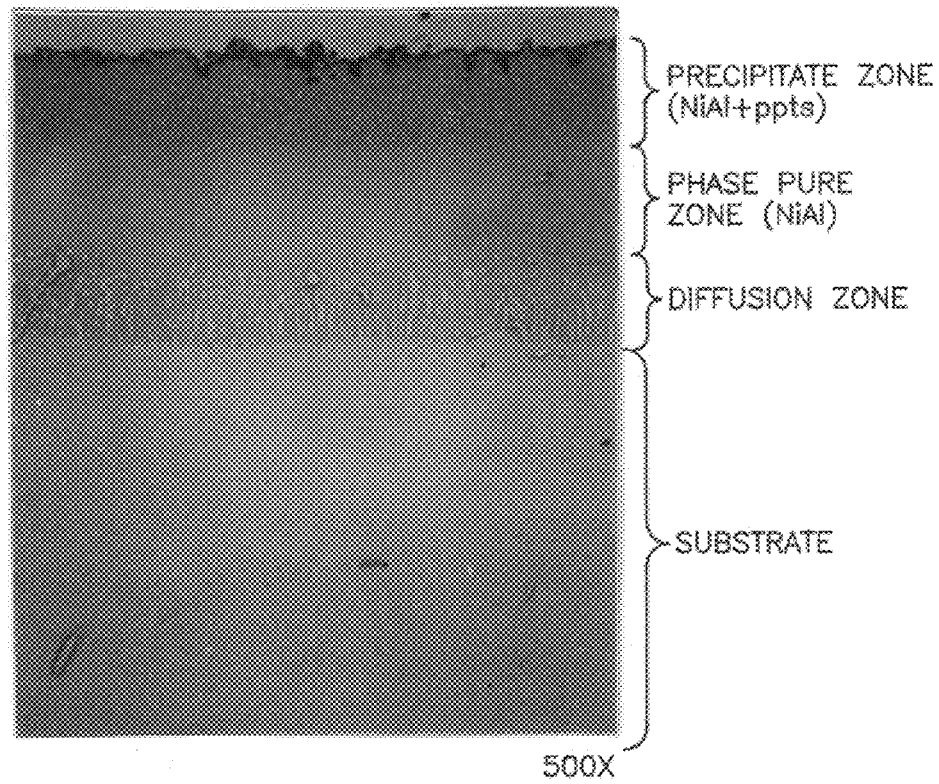
FIG. 2 is a photomicrograph of a prior art, high activity, inwardly diffusing, aluminide coating.

In comparison, FIG. 2 shows the microstructure of an inwardly diffusing prior art aluminide coating deposited on a nickel base substrate. As seen in FIG. 2, the resulting coating is characterized by a three zone microstructure (precipitate zone, phase pure zone, and diffusion zone) with considerable phase precipitation in the NiAl rich outer zone.

The low activity, outwardly diffusing localized aluminide coatings of the invention have excellent resistance to thermal fatigue cracking as well as excellent resistance to oxidation degradation. These coatings can be applied much thinner than high activity, inwardly diffusing localized aluminide coatings. The invention also has greater thermal fatigue resistance than that of a high activity, inwardly diffusing localized aluminide coating. Thus, the invention is much more desirable for certain applications such as reducing the propensity for crack formation in superalloy articles of gas turbine engines.

Another advantage of the invention is that it may be used to repair portions of a gas turbine engine component damaged during handling or during extensive engine service. For example, the invention may be employed to repair gas turbine blade tips.

Yet another advantage of the invention is that the desired two zone microstructure can be achieved with a one step heat treatment. This is a significant benefit in terms of cost and time.

From the foregoing description, one skilled in the art can easily ascertain the essential characteristics of this invention, and without departing from the spirit and scope thereof, can make various changes and modifications of the invention to adapt it to various uses and conditions.

What is claimed is:

1. A non-slurried, non-sputtered, low activity localized aluminide coating on a select, external portion of a nickel base superalloy article made by a. positioning a coating tape on a select, external portion of the article, said coating tape comprising a polymeric binder, a halide activator, a source of aluminum which reacts with said halide activator excluding elemental aluminum and aluminum silicon, and an inert ceramic material of aluminum oxide; and b. heating the coating tape and the article in an inert atmosphere between 1800° F. and 2050° F. for between four and seven hours thereby producing an article having a non-slurried, non-sputtered low activity localized aluminide coating on the select, external portion of the article, said coating having an outward diffusion aluminide coating microstructure characterized by two distinct zones, an inner diffusion zone having a thickness which is approximately half of the overall thickness of the low activity localized aluminide coating and an outer zone consisting essentially of pure NiAl and including between 20 and 28 percent, by weight, aluminum, the combined thickness of the outer zone and the inner zone being between 0.001 inches and 0.003 inches, wherein said coating is resistant to oxidation degradation and thermal fatigue cracking.

2. The low activity localized aluminide coating of claim 1 further comprising a foil material positioned over the coating tape prior to step b, said foil material selected from the group consisting of nickel foil and stainless steel foil.

3. The low activity localized aluminide coating of claim 1 wherein the binder is selected from the group consisting of polytetrafluoroethylene, polyethylene, urethane, acrylics and mixtures thereof.

4. The low activity localized aluminide coating of claim 1 wherein the halide activator is selected from the group consisting of aluminum tri-fluoride, sodium fluoride, ammonium fluoride, potassium fluoride, potassium bromide, and mixtures thereof.

5. The low activity localized aluminide coating of claim 1 wherein the source of aluminum is an aluminum compound selected from the group consisting of cobalt aluminum, chromium alurninum, iron aluminum, and mixtures thereof.

6. The low activity localized aluminide coating of claim 1 wherein the coating tape further comprises an inhibitor selected from the group consisting of chromium, cobalt, nickel, titanium, and mixtures thereof.

7. A low activity localized aluminide coating tape for producing a low activity localized aluminide coating on a select portion of a metallic article, said coating having an outward diffusion aluminide coating microstructure characterized by two distinct zones, an inner diffusion zone and an outer zone consisting essentially of pure NiAl and including between 20 and 28 weight percent aluminum, said coating tape consisting essentially of between 6 weight percent and 9 weight percent of a polymeric binder, between 0.25 weight percent and 5 weight percent of a halide activator comprising aluninum tri-fluoride, between 5 weight percent and 50 weight percent of a source of aluminum which reacts with said halide activator excluding elemental aluminum and aluminum silicon, and between 30 weight and 90 weight percent of an inert ceramic filler material of aluminum oxide, wherein said coating tape is capable of producing said low activity aluminide coating which is resistant to oxidation degradation and thermal fatigue cracking and comprises an outer zone consisting essentially of pure NiAl.

8. The low activity localized aluminide coating tape of claim 7, wherein the inert ceramic filler material is about 69 weight percent aluminum oxide.

9. The low activity localized aluminide coating tape of claim 7 further consisting essentially of between 5 weight percent and 20 weight percent of an inhibitor selected from the group consisting of chromium, cobalt, nickel, titanium, and mixtures thereof.

10. The low activity localized aluminide coating tape of claim 9 wherein the inhibitor is chromium between 5 weight percent and 10 weight percent.

11. The low activity localized aluminide coating tape of claim 7 wherein the tape is between 0.015 inches and 0.090 inches in thickness.

12. The low activity localized aluminide coating tape of claim 11 wherein the tape is between 0.030 inches and 0.060 inches in thickness.

13. The low activity localized aluminide coating tape of claim 7 wherein the source of aluminum is selected from the group consisting of cobalt aluminum, chromium aluminum, iron aluminum and mixtures thereof.

14. The low activity localized aluminide coating tape of claim 13 wherein the source of aluminum is about 30 weight percent chromium aluminum.

15. A low activity localized aluminide coating tape for producing a low activity localized aluminide coating on a select portion of a nickel base superalloy article, said coating having an outward diffusion aluminide coating microstructure characterized by two distinct zones, an inner diffusion zone and an outer zone consisting essentially of pure NiAl and including between about 20 and 28 weight percent of aluminum, said coating tape consisting essentially of about 5.7 weight percent polymeric binder, about 65.1 weight percent aluminum oxide, about 28.2 weight percent chromium aluminum and about 0.9 weight percent aluminum tri-fluoride, wherein said coating tape is capable of producing said low activity aluminide coating which is resistant to oxidation degradation and thermal fatigue cracking and comprises an outer zone consisting essentially of pure NiAl.

16. A repaired gas turbine engine component, comprising:

a gas turbine component having a metallic substrate with a defect therein;

a coating tape positioned over the defect, wherein said coating tape consists essentially of between 6 weight percent and 9 weight percent of a polymeric binder, between 0.25 weight percent and 5 weight percent of a halide activator comprising aluminum tri-fluoride, between 5 weight percent and 50 weight percent of a source of aluminum which reacts with said halide activator excluding elemental aluminum and aluminum silicon, and between 30 weight percent and 90 weight percent of an inert ceramic filler material of aluminum oxide prior to the tape being heat treated at between 1800° F. and 2050° F. for between four and seven hours after being applied to the defect, thereby producing a repaired gas turbine engine component having a low activity localized aluminide coating thereon, said coating having an outward diffusion aluminide coating microstructure characterized by two distinct zones, an inner diffusion zone having a thickness which is approximately half of the overall thickness of the low activity localized aluminide coating and an outer zone consisting essentially of pure NiAl.

17. A low activity localized aluminide coating tape consisting of about 5.7 weight percent polymeric binder, about 65.1 weight percent aluminum oxide, about 28.2 weight percent chromium aluminum and about 0.9 weight percent aluminum tri-fluoride, wherein said low activity localized aluminide coating tape is between 0.015 inches and 0.090 inches thick, wherein said coating tape is capable of producing a low activity aluminide coating which is resistant to oxidation degradation and thermal fatigue cracking and comprises an outer zone cosisting essentially of pure NiAl.

* * * * *